US006327743B1

(12) United States Patent
Rashid et al.

(10) Patent No.: US 6,327,743 B1
(45) Date of Patent: Dec. 11, 2001

(54) DOOR SAFETY DEVICE

(75) Inventors: Paul O. Rashid; Maria Marzullo, both of Wheaton, MD (US)

(73) Assignee: Maras, Inc., Wheaton, MD (US)

( * ) Notice: Subject to any disclaimer, the term of this patent is extended or adjusted under 35 U.S.C. 154(b) by 0 days.

(21) Appl. No.: 09/302,958

(22) Filed: Apr. 30, 1999

Related U.S. Application Data

(60) Provisional application No. 60/083,821, filed on May 1, 1998.

(51) Int. Cl.[7] ..... E05C 17/04

(52) U.S. Cl. ..... 16/82; 16/86 A; 292/338; 292/289

(58) Field of Search ..... 16/82, 86 A, 86 B, 16/86 R; 292/289, 297, 298, 338, 339, 342, DIG. 15; 403/3, 4, 329

(56) References Cited

U.S. PATENT DOCUMENTS

| | | | | |
|---|---|---|---|---|
| 870,216 | * | 11/1907 | Bennett et al. | 292/DIG. 15 X |
| 912,326 | * | 2/1909 | Scruggs | 292/338 |
| 1,288,988 | * | 12/1918 | Reed | 292/297 |
| 2,107,699 | * | 2/1938 | Groeschel et al. | 16/86 A |
| 2,249,294 | * | 7/1941 | Köhler | 16/82 X |
| 2,807,044 | * | 9/1957 | Blondy | 16/86 A |
| 3,200,434 | * | 8/1965 | Jarnot | 16/86 A |
| 3,971,100 | * | 7/1976 | Anop | 16/82 X |
| 4,015,867 | | 4/1977 | Siden . | |
| 4,192,283 | * | 3/1980 | Kridler et al. | 292/338 X |
| 4,310,947 | * | 1/1982 | Salerno | 16/86 A X |
| 4,398,317 | * | 8/1983 | Schubring | 16/82 |
| 4,982,474 | | 1/1991 | Kjellstrom . | |
| 5,123,685 | * | 6/1992 | Donovan | 16/82 X |
| 5,853,241 | * | 12/1998 | Sharrah et al. | 362/105 |
| 5,984,387 | * | 11/1999 | Zeller | 292/297 X |

* cited by examiner

*Primary Examiner*—Anthony Knight
*Assistant Examiner*—Enoch Peavey
(74) *Attorney, Agent, or Firm*—Pillsbury Winthrop LLP

(57) ABSTRACT

The present invention relates to a door safety device for use in conjunction with a door that is pivotably mounted to a wall. The safety device comprises a base member that mounts to either the door or the wall, and an engaging member that movably mounts to the engaging member for movement between operative and inoperative positions. In the operative position, the engaging member prevents the door from being moved into the closed position thereof. In the inoperative position, the engaging member is positioned such that the door can be moved to the closed position thereof.

49 Claims, 7 Drawing Sheets

DOOR SAFETY DEVICE

The present invention claims priority from U.S. Provisional Application of Rashid et al., Ser. No. 60/083,821, filed May 1, 1998, the entirety of which is hereby incorporated into the present application by reference.

FIELD OF THE INVENTION

The present invention relates to a door safety device. In particular, the present invention relates to a door safety device that can be installed on either the door or the wall out of reach of children and that can be easily moved between its operative and inoperative positions without removal from the door.

BACKGROUND OF THE INVENTION

When small children are present in a household it is frequently desirable to prevent them from fully closing doors in order to keep them from accidentally locking themselves within a room or to keep them from injuring their fingers or hands as the door closes. Devices known heretofore that are capable of preventing the door from closing are either mounted over the top of the door or attached to the doorknob. The devices that mount over the top of the door are inconvenient because they must be removed whenever it is desired to fully close the door. Mounting and removing this type of device can be difficult for shorter persons because they may be unable to reach the top of the door. The devices that mount to the doorknob are unsuitable because doorknobs can be reached by young children and thus can be removed by them, thereby defeating the purpose of using the device in the first place.

Thus, there exists a need for a door safety device that can be easily installed at a desired height anywhere along the door or wall and that can be moved between operative and inoperative positions without removal from the door.

SUMMARY OF THE INVENTION

To meet the above-described need, the present invention provides a door safety device for use in conjunction with a door that is movably mounted to a wall. The door safety device comprises a base member that mounts at a desired height on either the door or the wall, and an engaging member movably mounted to the base member for movement between an operative position and an inoperative position. The engaging member is constructed and arranged such that, when the engaging member is moved to the operative position thereof, moving the door toward the closed position thereof causes the engaging member to engage the door or the wall (whichever one it is not mounted to) so as to prevent the door from moving into the closed position thereof. The engaging member is also constructed and arranged such that, when the engaging member is moved to the inoperative position thereof, the door can be moved into the closed position thereof without interference from the engaging member.

The desired height at which the base member is mounted may be any height chosen by the user. For example, in homes with small children it may desirable to install the device within easy reach of adults so that the engaging member can be moved between the operative and inoperative positions when necessary, yet out of reach of small children so that they cannot move the engaging member to the inoperative position and then fully close the door. Alternatively, in homes where there are no children present, it may be desirable to mount the device down towards the lower corner of the door or door jamb so that it does not draw attention to itself. Thus, the desired height may be anywhere along the door or wall and is not to be limited to any particular height.

Other objects, features, and advantages of the present invention will become apparent from the following detailed description, the accompanying drawings, and the appended claims.

DETAILED DESCRIPTION OF THE INVENTION

Figure 1:
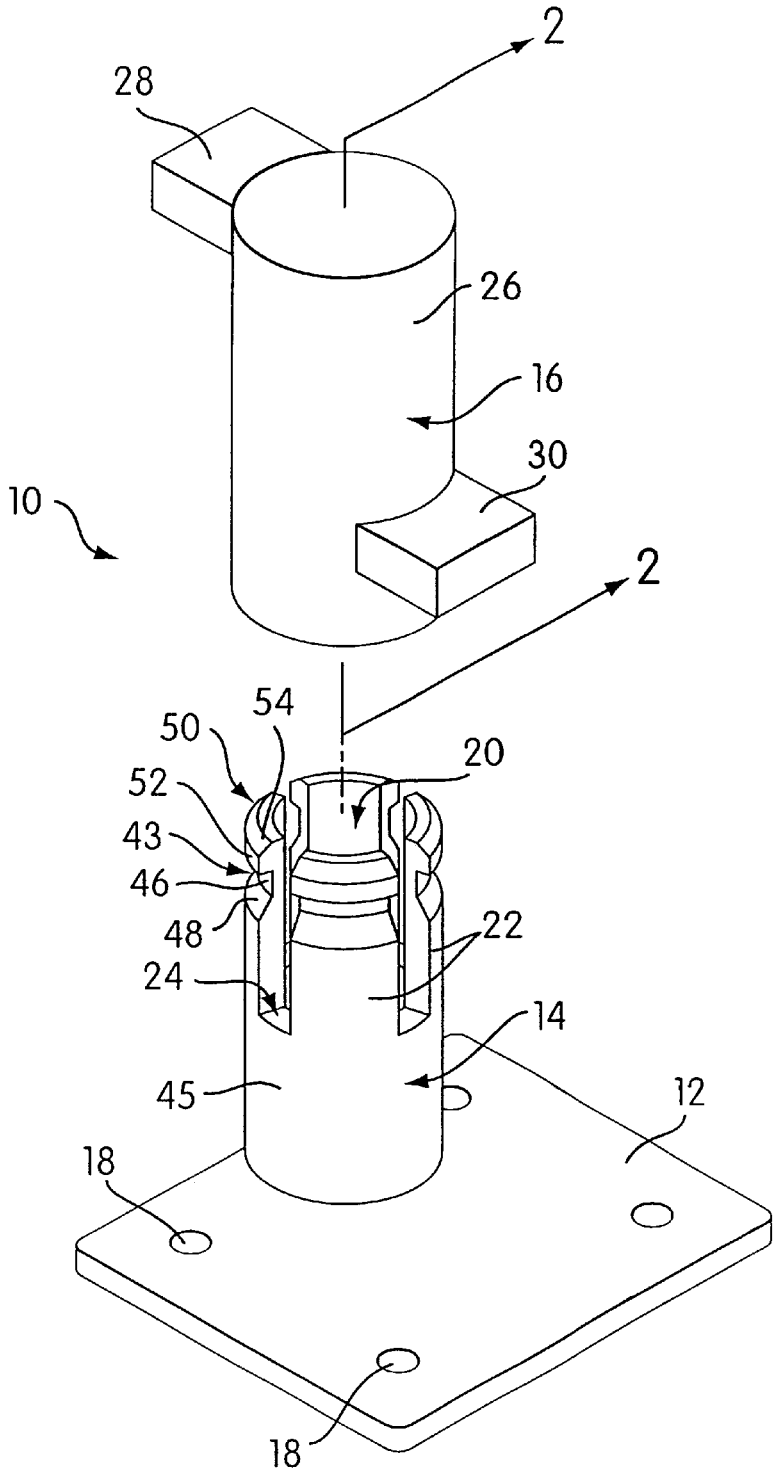
FIG. 1 shows an exploded perspective view of a door safety device according to the present invention.

FIGS. 1–6 show a door safety device, generally designated 10, for preventing a door from closing. As shown in FIG. 1, the device 10 includes a base member 12 having a post member 14 mounted thereto, and an engaging member 16 shown in exploded view. The base member 12 is an essentially rectangular planar structure and includes a plurality of apertures 18 that receive conventional threaded fasteners for securing the base member 12 to a conventional interior door in a house. It is to be understood that base member 12 may also be secured to the door by means of an adhesive webbing (not shown) formed on the back surface thereof.

The post member 14 is a cylindrical, tubular structure that includes a central bore 20. A plurality of identical circumferentially spaced tab members 22 are formed at the end of the post member 14 distal the base member 12 and a plurality of identical circumferentially spaced notches 24 extend axially between the tab members 22. The engaging member 16 includes a cylindrical body portion 26 and upper and lower stopping members 28 and 30 respectively. The upper and lower stopping members 28, 30 extend generally radially outwardly from the central axis of the cylindrical body portion 26 in directions that are approximately one hundred and eighty (180) degrees apart. Preferably, the lower stopping member 30 is spaced axially from the lower edge of the cylindrical body portion 26, but it is also contemplated that it may extend continuous with the lower edge.

Figure 2:
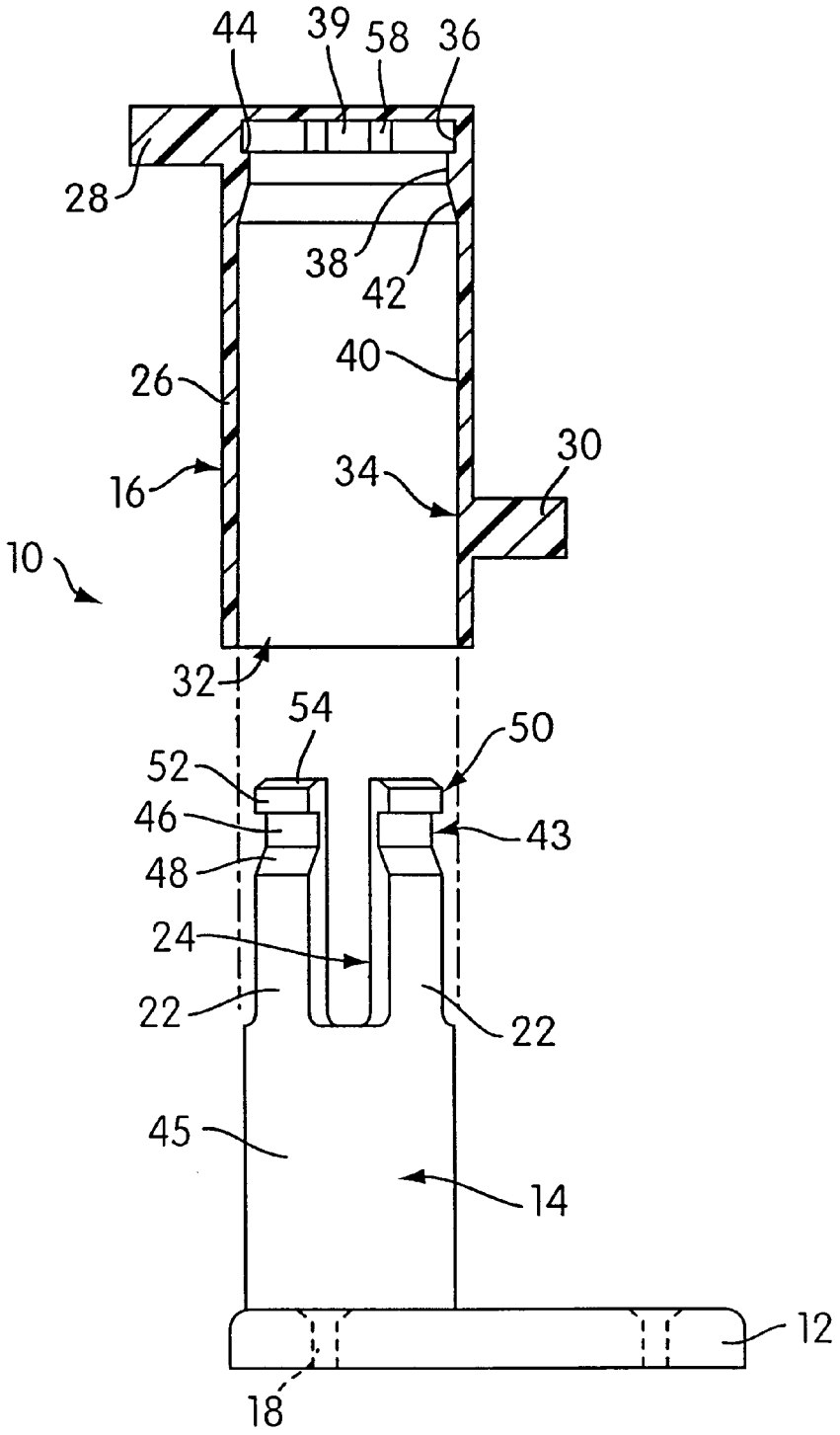
FIG. 2 is an exploded sectional view of the door safety device taken through the line 2—2 in FIG. 1.

As shown in FIG. 2, the cylindrical body portion 26 of the engaging member 16 is tubular and includes a cylindrical bore 32 sized to rotatably receive the post member 14. The bore 32 has an interior wall, generally designated 34, and includes a first cylindrical section 36, a second cylindrical section 38, a third cylindrical section 40, and a conical section 42 disposed between the second and third cylindrical sections 38, 40. An annular planar wall portion 44 extends generally radially between the first and second cylindrical sections 36 and 38, respectively. Four radially inwardly extending wedge-shaped structures 39 integrally formed with the engaging member 16 are circumferentially spaced around the first cylindrical section 36 of the engaging member. These wedge-shaped structures 39 are spaced about ninety (90) degrees apart and are sized to be received within the notches 24 in the post member 14 when the engaging member 16 is rotatably mounted on the post member 14.

The post member 14 has a cylindrical exterior surface 45. Each tab member 22 formed on the post member 14 includes a groove structure, generally designated 43, which comprises a first surface section 46 extending generally axially with respect to the post member 14 and a second surface section 48 extending between the exterior surface 45 and the first surface section 46. The free end of each tab member 22 has an outwardly extending lip structure 50 which includes a first surface segment 52 and a second surface segment 54.

Preferably, the base member 12, the post member 14, and the engaging member 16 are made of a resilient molded plastic material so that the door safety device 10 is of two-piece construction. The base member 12 and the post member 14 are preferably one integral injection-molded piece and the engaging member 14 constitutes the second piece. Because of this resilient plastic construction, the engaging member 16 can be easily mounted on the post member 14. More specifically, it can be appreciated from FIG. 2 that the bore 32 is sized to allow the engaging member 16 to snap-fit on the post member 14 to allow the bi-directional rotation thereof with respect to the post member 14. When the engaging member 16 is snapped onto the post member 14, the lip structures 50 are rotatably received within the first cylindrical section 36 of the engaging member 16 such that the cylindrical first surface segment 52 and the portion of the wall 34 in the first cylindrical section 36 are disposed in close relation to one another. Therefore, it can be appreciated that the lip structures 50 cooperate with the annular, planar wall portion 44 to hold the engaging member 16 rotatably on the post member 14 and prevent the axial displacement of the engaging member 16 away from the base member 12.

The second surface segment 54 of each of the lip structures 50 is angled inwardly such that the tab members 22 are urged inwardly as the engaging member 16 is mounted on the post member 14. The tab members 22 resiliently bias back to their original position when the lip structures 50 reach the first cylindrical section 36, thereby facilitating the easy snap-fitting of the engaging member 16 on the post member 14.

It can be appreciated that when the engaging member 16 is snap-fit on the post member 14, the wedge-shaped structures 39 cooperate with the tab members 22 and the notches 24 to releasably hold the engaging member 16 in four indexed rotational positions. The side surfaces 58 of the wedge-shaped structures 39 are angled to allow the lip structures 50 to slide there across to the next incremental position as the engaging member 16 is manually rotated. This sliding action will be described in more detail hereinbelow with respect to the operation of the door safety device 10. It can be appreciated from FIG. 2 that because the post member 14 is positioned adjacent an edge of the base member 12, the cover member 16 can be rotated so that the upper and lower stopping members 28, 30 extend beyond the edge of the base member 12.

Figure 3:
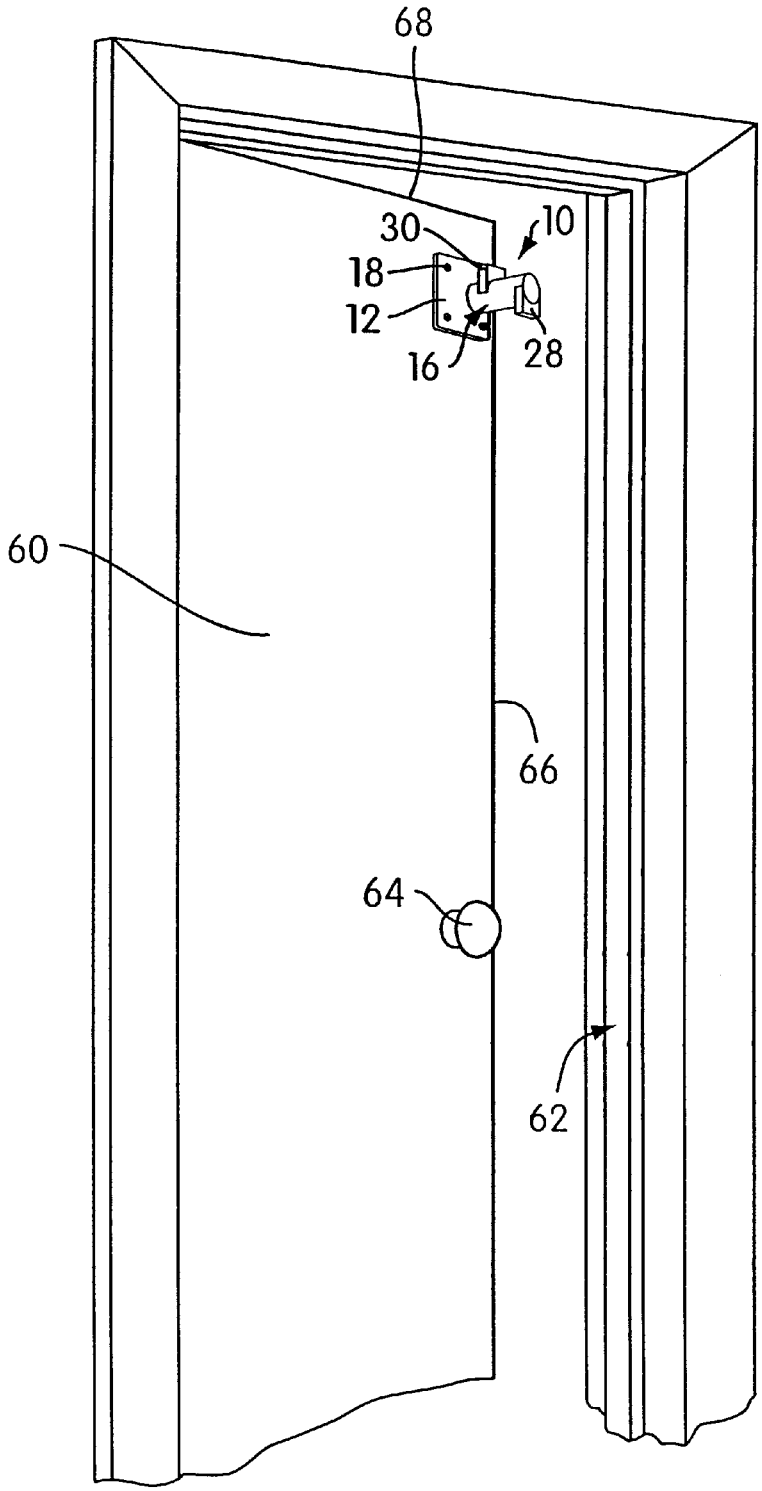
FIG. 3 is a fragmentary perspective view showing the door safety device installed on a conventional interior door.

FIG. 3 shows the door safety device 10 secured to an interior door 60 in a house. The door 60 is shown mounted to a door frame 62 in a conventional manner for pivotal movement between open and closed positions. The device 10 is mounted proximate a vertical edge of the door 60, preferably above the doorknob 64 so that the door safety device 10 is placed out of reach of children but can easily be reached by an adult. Although the device 10 is shown mounted to the door 60 proximate the vertical edge 66 thereof which is opposite the hinges (not shown), the device 10 could alternatively be mounted proximate the top edge 68 of the door 60.

Figure 4:
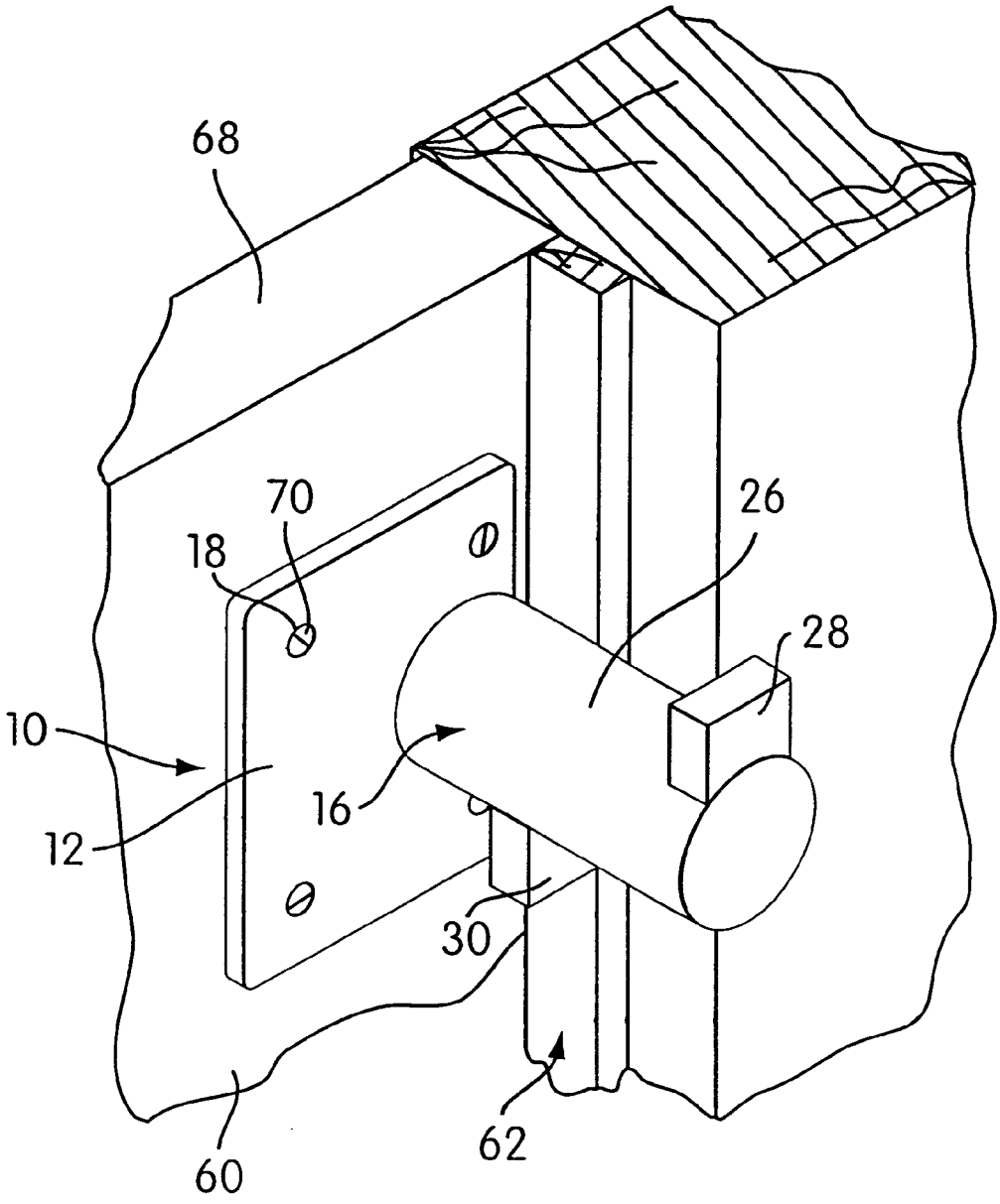
FIG. 4: is an enlarged fragmentary perspective view showing the door safety device installed on a door and showing the device in a non-operative position.

FIG. 4 shows the door safety device 10 secured to the door 60 with a plurality of conventional threaded fasteners 70, although a layer of adhesive could be used in place of the fasteners 70. The device 10 in FIG. 4 is in the non-operative position in which it does not interfere with the normal opening and closing of the door 60. The non-operative position is realized when the engaging member 16 is in a rotational position such that neither the upper nor the lower stopping members 28, 30 extend beyond the adjacent edge of the base member 12. Therefore, neither stopping member 28, 30 comes in contact with the door frame 62 as the door is opened or closed. It is to be understood that there may be only one non-operative position rather than the two disclosed.

Figure 5:
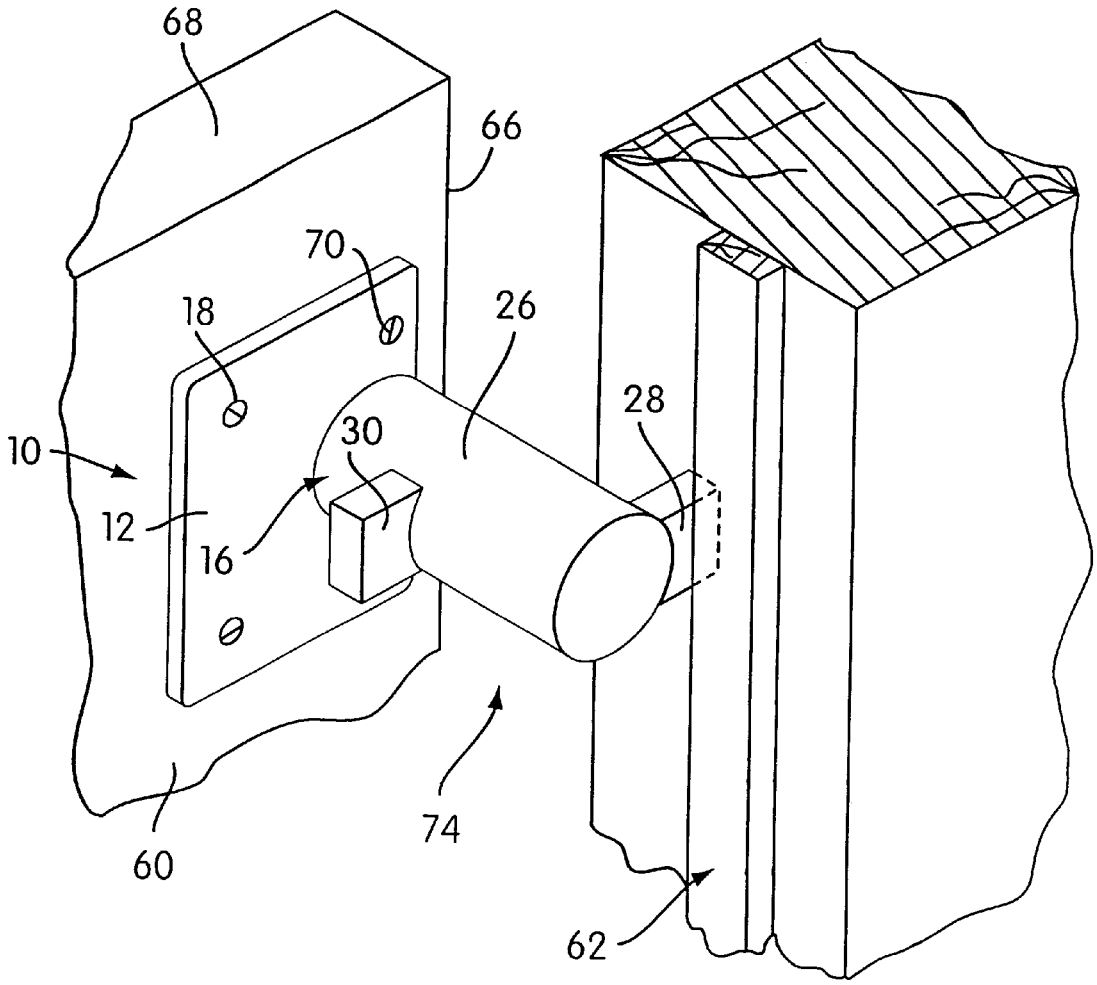
FIG. 5 is an enlarged fragmentary perspective view of the device of FIG. 4 showing the device in a first operative position.

The engaging member 16 can be rotated to one of two operative positions in which one of the stopping members 28, 30 is positioned to prevent the complete closure of the door 60. The first operative position is shown in FIG. 5. In this position, the upper stopping member 28 extends outwardly towards the adjacent edge 66 of the door 60 and holds the door in a partially closed position a predetermined distance from the door frame 62. The upper stopping member 28 assures that there is always a gap 74 between the door 60 and the door frame 62. The door can be opened freely, but cannot be closed beyond the position shown in FIG. 5 unless the engaging member 16 is first rotated to the non-operative position shown in FIG. 4. When the engaging member 16 is in this first operative position, a child's fingers cannot be accidentally pinched between the door 60 and the door frame 62 of a closing door.

Figure 6:
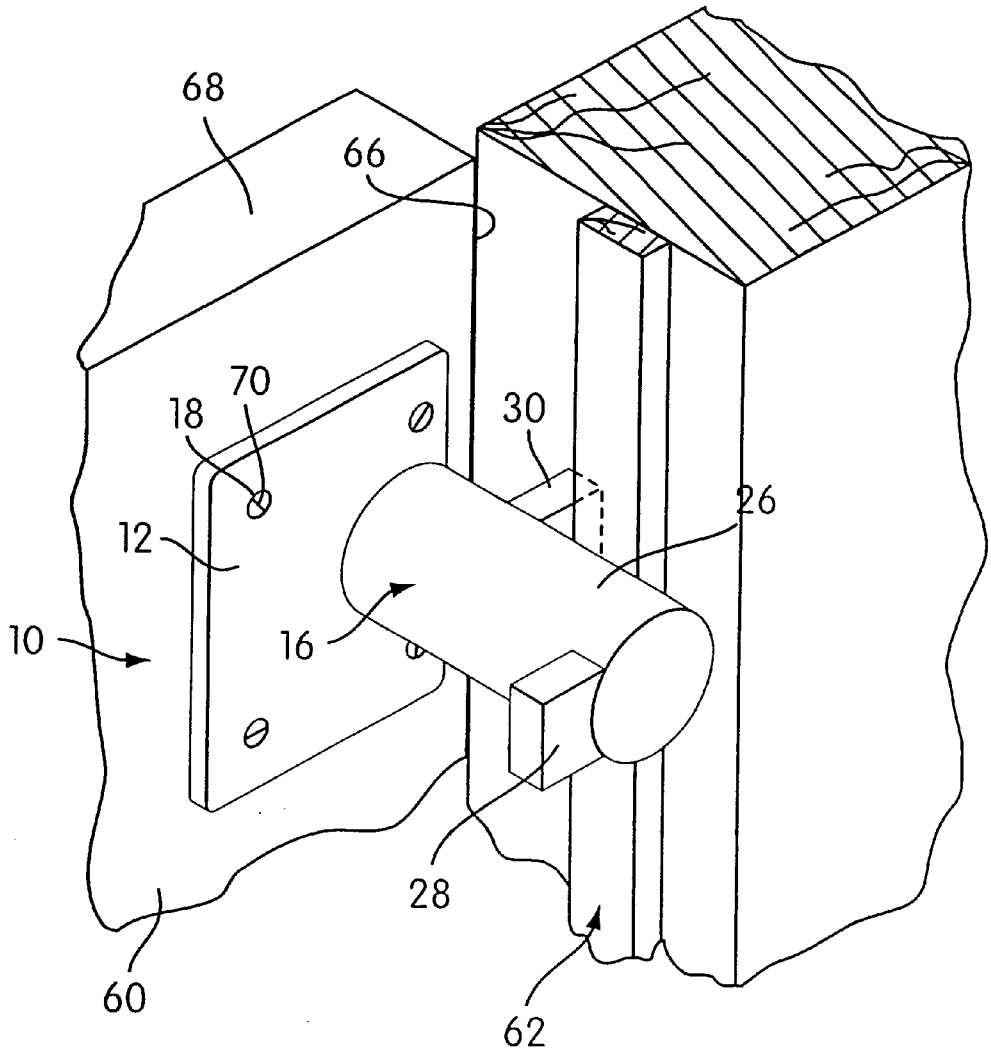
FIG. 6 is an enlarged fragmentary perspective view showing the device of FIG. 4 in a second operative position.

The second operative position is shown in FIG. 6. The engaging member 16 is in a rotational position in which the lower stopping member 30 extends outwardly beyond the adjacent edge of the base member 12 beyond the proximate vertical edge 66 of the door 60. When the engaging member 16 is in this second operative position, the door 60 can be pivoted into the door frame 62 to another partially closed position, but is precluded from latching because the lower stopping member 30 extends between the door 60 and the door frame 62. This second operative position of the door safety device 10 is useful in many situations. It is advantageous, for example, when an adult desires to close the door to keep heat in a room or light out of a room and yet prevent the door 60 from latching so that the child does not accidentally lock the door. In addition, in either operative position, the door safety device of the present invention may be used when a person is carrying cumbersome loads and desires to keep certain doors easily operable without having to free their hands to operate the door knob.

As mentioned before, it is preferable, although not necessary, to axially space the lower stopping member 30 from the lower edge of the cylindrical body member 26. By spacing the lower stopping member 30 from the lower edge, a wider gap is provided between the door 60 and the door frame 62. This wider gap prevents the situation where the lower stopping member 30 of the door safety device 10 engages the door frame 62, but bending of the door 60 itself allows the door to latch. It is, however, contemplated that the lower stopping member 30 may be formed continuous with the lower edge of the cylindrical body member 26.

It can be appreciated that the engaging member 16 can easily be manually rotated with respect to the post member 14 to reconfigure the device 10 to effect the non-operative or first or second operative positions according to user preference. It will be recalled that the engaging member 16 is releasably held in a rotational position by the wedge-shaped structures 39 which are sized to be received within the notches 24 in the post member 14. When the engaging member 16 is in a given rotational position, each of the wedge-shaped structures 39 is within one of the notches 24. A manual rotational force exerted on the engaging member 16 about the axis of rotation causes the lip structures 50 to slide across the side surfaces 58 of the wedge-shaped structures 39, thereby causing the tab members 22 to move resiliently, radially inward. This inward movement of the tab members 22 allows the wedge-shaped structures 39 to slide across the tab members 22 so that the engaging member 16 can be rotated. The next rotational position is realized when each wedge-shaped structure 39 reaches a corresponding notch 24 in the post member 14 and the tab members 22 resiliently return to their original position. It can be appreciated that the engaging member 16 can be rotated in either rotational direction until the desired configuration is realized.

As mentioned above, the door safety device 10 can alternatively be mounted proximate the top edge 68 of the door 60. When so mounted, the rotation of the engaging member 16 would position the upper and lower stopping members 28, 30 between the top edge 68 of the door 60 and the door frame 62. It can be appreciated that the device 10 would operate the same way that it does when mounted proximate a vertical edge of the door 60. It is also to be understood that the door safety device 10 may be mounted to the surface of the door frame rather than the surface of the door. Such a mounting may be desirable to prevent the device 10 from striking a wall or other such objects as the door swings between its opened and closed positions.

The surfaces on the upper and lower stopping members 28, 30 which come in contact with the door frame 62 can optionally be provided with pad members (not shown) to prevent damage to the door frame 62 when a stopping member 28, 30 comes in contact therewith as the door 60 closes. The pad members can be made from any of a plurality of materials including rubber, resilient plastic, leather or any other appropriate material known to one skilled in the art.

Figure 7:
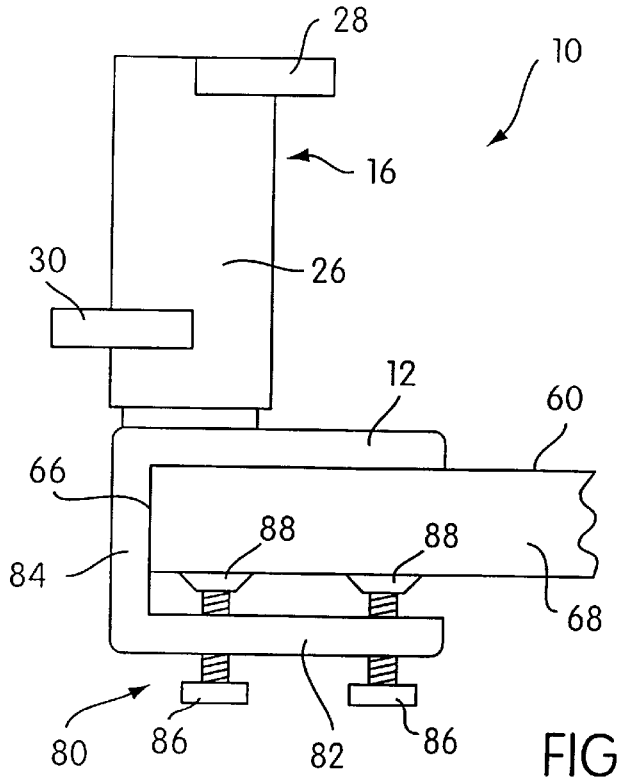
FIG. 7 is a top view of an alternative arrangement for mounting the device of the present invention to the door.

FIG. 7 illustrates an alternative method of mounting the door safety device of the present invention. The door safety device 10, according to this alternate method, has an adjustable mounting assembly, generally indicated at 80, adapted to mount the device to doors of various thicknesses. The adjustable mounting assembly 80 includes a mounting plate 82 extending generally parallel with respect to the base member 12 and connected therewith by a transversely extending member 84. The mounting plate 82 has a set of openings configured to threadingly receive a set of adjustable door engaging elements 86. Each of the door engaging elements 86 is threaded and includes engaging feet 88. These engaging feet 88 are mounted to the ends of the door engaging elements 86, preferably in a pivoted manner like that of a conventional C-clamp to allow for firm engagement with uneven surfaces, and adapted to engage the surface of the door 60.

To mount the door safety device 10 according to this alternate method, the device is placed on the door 60 at a desired location with the base member 12 and the mounting plate 82 facing opposing surfaces of the door 60. The base plate 12 is held in tight engagement with the surface of the door which it faces and the door engaging elements 86 are turned in a tightening manner such that the door engaging feet 88 tightly engage the door 60 to thereby mount the device 10. It is to be understood that the surfaces of the engaging feet 88 and the base member 12 may be coated or padded to prevent damage to the surface of the door 60.

Figure 8:
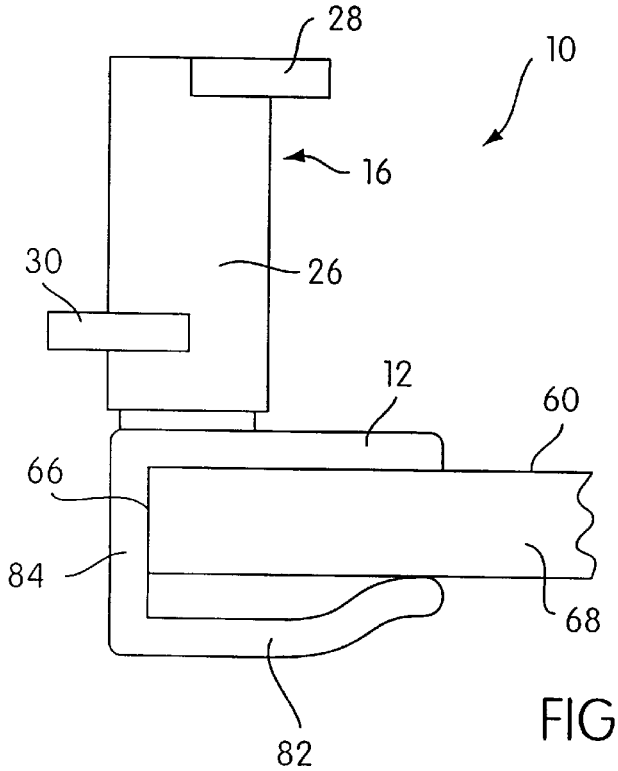
FIG. 8 is a top view of another alternative arrangement for mounting the device of the present invention to the door.

Further, it is also contemplated that the door engaging elements 86 not be used and that the material of the mounting plate 82 and the transversely extending member 84 be resilient enough to allow the door safety device to be simply clipped on to doors of varying sizes with the base member 12 and the mounting plate 82 in tight engagement with opposing sides of the door. An example of such a construction is illustrated in FIG. 8.

It will be realized that the foregoing preferred embodiment of the present invention has been shown and described in detail for the purposes of illustrating the functional and structural principles of the present invention and is subject to change without departure from such principles. Therefore, the present invention includes all modifications encompassed within the spirit and scope of the appended claims.

What is claimed:

1. A door safety device for use in conjunction with a door that is movably mounted to a wall, the wall having a pair of opposing sides and an opening formed therethrough from one of the opposing sides thereof to the other of the opposing sides thereof, the door being movable between an open position wherein the door uncovers the opening to allow the travel of persons therethrough and a closed position wherein the door covers the opening to prevent the travel of persons therethrough, said door safety device comprising:

a base member constructed and arranged to be mounted at a desired height on one of the door and the wall;

an engaging member rotatably coupled to said base member to enable said engaging member to be rotated relative to said base member between an inoperative position and an operative position;

said engaging member being constructed and arranged such that, when said base member is mounted as aforesaid and said engaging member is moved to the operative position thereof, moving the door toward the closed position thereof causes said engaging member to engage the other of the door and the wall so as to prevent the door from moving into the closed position thereof and thereby maintain the door in a partially closed position;

said engaging member being constructed and arranged such that, when said base member is mounted as aforesaid and said engaging member is moved to the inoperative position thereof, the door can be moved into the closed position thereof without interference from said engaging member.

2. The door safety device according to claim 1, wherein said base member has a resiliently movable tab with projection receiving spaces defined on opposing sides thereof and wherein said engaging member has a projection that is configured to be received within said projection receiving spaces, said projection and said resiliently movable tab being constructed and arranged such that (1) said projection is received within a first of said projection receiving spaces when said engaging member is in the operative position thereof with said tab providing resistance to movement of said projection from said first projection receiving space, thereby releaseably retaining said engaging member in the operative position thereof and (2) said projection is received within a second one of said projection receiving spaces when said engaging member is in said inoperative position thereof with said tab providing resistance to movement of said projection from said second projection receiving space, thereby releaseably retaining said engaging member in the inoperative position thereof, said projection and said tab being constructed and arranged such that as said engaging member is being moved between the operative and inoperative positions thereof said projection engages and moves said tab against the resiliency thereof so that said projection can be moved between the first and second projection receiving spaces and said tab thereafter resiliently returns to its initial position to provide resistance to movement of said projection.

3. The door safety device according to claim 1, wherein said engaging member is movable to a second operative position;

said engaging member being constructed and arranged such that, when said base member is mounted as aforesaid and said engaging member is moved to the second operative position thereof, moving the door toward the closed position thereof causes said engaging member to engage the other of the door and the portion of the wall so as to prevent the door from moving into the closed position thereof and thereby maintain the door at a second partially closed position, said second partially closed position being closer to the closed position of the door than the aforesaid partially closed position.

4. The door safety device according to claim 3, wherein said base member has a generally cylindrical post member and wherein said engaging member has a generally tubular body member, said engaging member being mounted to said base member by placing said body member over said post member such that said engaging member can be rotated between the operative, second operative, and inoperative positions thereof.

5. The door safety device according to 4 claim wherein said engaging member has first and second stopping members extending radially from said body member and spaced generally axially apart from one another along said body member;

said first stopping member being constructed and arranged such that, when said base member is mounted as aforesaid and said engaging member is moved to the operative position thereof, moving the door toward the closed position thereof causes said first stopping member to engage the other of the door and the wall so as to prevent the door from moving into the closed position thereof and thereby maintain the door in the aforesaid partially closed position thereof;

said second stopping member being constructed and arranged such that, when said base member is mounted as aforesaid and said engaging member is moved to the second operative position thereof, moving the door into the closed position thereof causes said second stopping member to engage the other of the door and the wall so as to prevent the door from moving into the closed position thereof and thereby maintain the door in the aforesaid second partially closed position thereof.

6. The door safety device according to claim 5, wherein said base member has a plurality of fastener receiving openings configured such that a plurality of fasteners can be inserted there through to mount said base member.

7. The door safety device according to claim 5, wherein said base member has a layer of pressure-sensitive adhesive formed thereon such that said base member can be mounted as aforesaid by engaging the adhesive layer to the one of the door and the wall and applying sufficient pressure to affect adhesive bonding.

8. The door safety device according to claim 1, wherein said base member has a generally cylindrical post member and wherein said engaging member has a generally tubular body member, said engaging member being mounted to said base member by placing said body member over said post member such that said engaging member can be rotated between the operative and inoperative positions thereof.

9. The door safety device according to claim 8 wherein said engaging member has a stopping member extending generally radially from said body member, said stopping member being constructed and arranged such that, when said base member is mounted as aforesaid and said engaging member is moved to the operative position thereof, moving the door toward the closed position thereof causes said stopping member to engage the other of the door and the wall so as to prevent the door from moving into the closed position thereof and thereby maintain the door in the partially closed position.

10. The door safety device according to claim 9 wherein said base member has a plurality of fastener receiving openings configured such that a plurality of fasteners can be inserted there through to mount said base member.

11. The door safety device according to claim 9 wherein said base member has a layer of pressure-sensitive adhesive formed thereon such that said base member can be mounted as aforesaid by engaging the adhesive layer to the one of the door and the wall and applying sufficient pressure to affect adhesive bonding.

12. In combination with a door that is movably mounted to a wall, said wall having a pair of opposing sides and an opening formed therethrough from one of said opposing sides thereof to the other of said opposing sides thereof, said door being movable between an open position wherein said door uncovers said opening to allow the travel of persons therethrough and a closed position wherein said door covers said opening to prevent the travel of persons therethrough, a door safety device comprising:

a base member mounted at a desired height on one of said door and said wall;

an engaging member rotatably coupled to said base member to enable said engaging member to be rotated relative to said base member between an inoperative position and an operative position;

said engaging member being constructed and arranged such that, when said engaging member is moved to the operative position thereof, moving said door toward the closed position thereof causes said engaging member to engage the other of said door and said wall so as to prevent the door from moving into the closed position thereof and thereby maintain the door in a partially closed position;

said engaging member being constructed and arranged such that, when said engaging member is moved to the inoperative position thereof, said door can be moved into the closed position thereof without interference from said engaging member.

13. The combination according to claim 12, wherein said base member has a resiliently movable tab with projection receiving spaces defined on opposing sides thereof and wherein said engaging member has a projection that is configured to be received within said projection receiving spaces, said projection and said resiliently movable tab being constructed and arranged such that (1) said projection is received within a first of said projection receiving spaces when said engaging member is in the operative position thereof with said tab providing resistance to movement of said projection from said first projection receiving space, thereby releaseably retaining said engaging member in the operative position thereof and (2) said projection is received within a second one of said projection receiving spaces when said engaging member is in said inoperative position thereof with said tab providing resistance to movement of said projection from said second projection receiving space, thereby releaseably retaining said engaging member in the inoperative position thereof, said projection and said tab being constructed and arranged such that as said engaging member is being moved between the operative and inoperative positions thereof said projection engages and moves said tab against the resiliency thereof so that said projection can be moved between the first and second projection receiving spaces and said tab thereafter resiliently returns to its initial position to provide resistance to movement of said projection.

14. The combination according to claim 12, wherein said engaging member is movable to a second operative position;

said engaging member being constructed and arranged such that, when said engaging member is moved to the second operative position thereof, moving the door toward the closed position thereof causes said engaging member to engage the other of said door and said wall so as to prevent the door from moving into the closed position thereof and thereby maintain said door in a second partially closed position, said second partially closed position being closer to the closed position of the door than the aforesaid partially closed position.

15. The combination according to claim 14, wherein said base member has a generally cylindrical post member and wherein said engaging member has a generally tubular body member, said engaging member being mounted to said base member by placing said body member over said post member such that said engaging member can be rotated between the operative, second operative, and inoperative positions thereof.

16. The combination according to claim 15, wherein said engaging member has first and second stopping members extending radially from said body member and spaced generally axially apart from one another along said body member;

said first stopping member being constructed and arranged such that, when said engaging member is moved to the operative position thereof, moving the door toward the closed position thereof causes said first stopping member to engage the other of said door and said wall so as to prevent the door from moving into the closed position thereof and thereby maintain said door in the aforesaid partially closed position thereof;

said second stopping member being constructed and arranged such that, when said engaging member is moved to the second operative position thereof, moving the door into the closed position thereof causes said second stopping member to engage the other of said door and said wall so as to prevent the door from moving into the closed position thereof and thereby maintain said door in the aforesaid second partially closed position thereof.

17. The combination according to claim 14, wherein said base member has a plurality of fastener receiving openings configured such that a plurality of fasteners can be inserted there through to mount said base member.

18. The combination according to claim 14, wherein said base member has a layer of pressure-sensitive adhesive formed thereon such that said base member is mounted as aforesaid by engaging the adhesive layer to the one of the door and the wall and applying sufficient pressure affect adhesive bonding.

19. The combination according to claim 12, wherein said base member has a generally cylindrical post member and wherein said engaging member has a generally tubular body member, said engaging member being mounted to said base member by placing said body member over said post member such that said engaging member can be rotated between the operative and inoperative positions thereof.

20. The combination according to claim 19, wherein said engaging member has a stopping member extending generally radially from said body member, said stopping member being constructed and arranged such that, when said engaging member is moved to the operative position thereof, moving said door toward the closed position thereof causes said stopping member to engage the other of said door and said wall so as to prevent the door from moving into the closed position thereof.

21. The combination according to claim 20, wherein said base member has a plurality of fastener receiving openings configured such that a plurality of fasteners can be inserted there through to mount said base member.

22. The combination according to claim 20, wherein said base member has a layer of pressure-sensitive adhesive formed thereon such that said base member is mounted as aforesaid by engaging the adhesive layer to the one of said door and said wall and applying sufficient pressure to affect adhesive bonding.

23. The combination according to claim 12, wherein said door is pivotally mounted to said wall for pivotal movement between said open and closed positions thereof.

24. The combination according to claim 12, wherein said wall includes a door jamb that extends peripherally about the opening through said wall.

25. The combination according to claim 12, wherein said base member is mounted to said door.

26. In combination with a door that is movably mounted to a wall, said wall having a pair of opposing sides and an opening formed therethrough from one of said opposing sides thereof to the other of said opposing sides thereof, said door being movable between an open position wherein said door uncovers said opening to allow the travel of persons therethrough and a closed position wherein said door covers said opening to prevent the travel of persons therethrough, a door safety device comprising:

a molded plastic base member constructed and arranged to be mounted at a desired height on one of the door and the wall, said base member having an engaging member mounting portion;

a molded plastic engaging member having a base member mounting portion, said base member mounting portion being rotatably mounted to said engaging member mounting portion to enable said engaging member to be rotated relative to said base member between an operative position and an inoperative position, said base member mounting portion and said engaging member mounting portion being coupled together in a snap-fit with interengaging surfaces interengaging one another to retain said engaging member on said base member;

said engaging member being constructed and arranged such that, when said engaging member is rotated to the operative position thereof, moving said door toward the closed position thereof causes said engaging member to engage the other of said door and said wall so as to prevent the door from moving into the closed position thereof and thereby maintain the door in a partially closed position;

said engaging member being constructed and arranged such that, when said engaging member is rotated to the inoperative position thereof, said door can be moved into the closed position thereof without interference from said engaging member.

27. A door safety device according to claim 26, wherein said engaging member and said base member are constructed and arranged such that said engaging member rotates between the inoperative and operative positions thereof in an indexing manner.

28. A door safety device according to claim 27, wherein the engaging member mounting portion of said base member has a resiliently movable tab with projection receiving spaces defined on opposing sides thereof and wherein the base member mounting portion of said engaging member has a projection that is configured to be received within said projection receiving spaces, said projection and said resiliently movable tab being constructed and arranged such that (1) said projection is received within a first of said projection receiving spaces when said engaging member is in the operative position thereof with said tab providing resistance to movement of said projection from said first projection receiving space, thereby releaseably retaining said engaging member in the operative position thereof and (2) said projection is received within a second one of said projection receiving space when said engaging member is in said inoperative position thereof with said tab providing resistance to movement of said projection from said second projection receiving space, thereby releaseably retaining said engaging member in the inoperative position thereof, said projection and said tab being constructed and arranged such that as said engaging member is being rotated between the operative and inoperative positions thereof said projection engages and moves said tab against the resiliency thereof so that said projection can be moved between the first and second projection receiving spaces and said tab thereafter resiliently returns to its initial position to provide resistance to movement of said projection.

29. A door safety device according to claim 28, wherein the engaging member mounting portion of said base member is a generally cylindrical post member and wherein the base member mounting portion of said engaging member has a generally tubular body member, said engaging member being mounted to said base member by placing said body member over said post member such that said engaging member can be rotated between the operative and inoperative positions thereof.

30. A door safety device according to claim 29, wherein said engaging member has a stopping member extending generally radially from said body member, said stopping member being constructed and arranged such that, when said base member is mounted as aforesaid and said engaging member is rotated to the operative position thereof, moving the door toward the closed position thereof causes said stopping member to engage the other of the door and the wall so as to prevent the door from moving into the closed position thereof and thereby maintain the door in the partially closed position.

31. A door safety device according to claim 30, wherein said base member has a plurality of fastener receiving openings configured such that a plurality of fasteners can be inserted there through to mount said base member.

32. A door safety device according to claim 30, wherein said base member has a layer of pressure-sensitive adhesive formed thereon such that said base member can be mounted as aforesaid by engaging the adhesive layer to the one of the door and the wall and applying sufficient pressure affect adhesive bonding.

33. A door safety device according to claim 27, wherein said engaging member is rotatable to a second operative position;

said engaging member being constructed and arranged such that, when said base member is mounted as aforesaid and said engaging member is rotated to the second operative position thereof, moving the door toward the closed position thereof causes said engaging member to engage the other of the door and the portion of the wall so as to prevent the door from moving into the closed position thereof and thereby maintain the door at a second partially closed position, said second partially closed position being closer to the closed position of the door than the aforesaid partially closed position.

34. A door safety device according to claim 33, wherein said base member has a generally cylindrical post member and wherein said engaging member has a generally tubular body member, said engaging member being mounted to said base member by placing said body member over said post member such that said engaging member can be rotated between the operative, second operative, and inoperative positions thereof.

35. A door safety device according to claim 34, wherein said engaging member has first and second stopping members extending radially from said body member and spaced generally axially apart from one another along said body member;

said first stopping member being constructed and arranged such that, when said base member is mounted as aforesaid and said engaging member is rotated to the operative position thereof, moving the door toward the closed position thereof causes said first stopping member to engage the other of the door and the wall so as to prevent the door from moving into the closed position thereof and thereby maintain the door in the aforesaid partially closed position thereof;

said second stopping member being constructed and arranged such that, when said base member is mounted as aforesaid and said engaging member is rotated to the second operative position thereof, moving the door into the closed position thereof causes said second stopping member to engage the other of the door and the wall so as to prevent the door from moving into the closed position thereof and thereby maintain the door in the aforesaid second partially closed position thereof.

36. A door safety device according to claim 35, wherein said base member has a plurality of fastener receiving openings configured such that a plurality of fasteners can be inserted there through to mount said base member.

37. A door safety device according to claim 35, wherein said base member has a layer of pressure-sensitive adhesive formed thereon such that said base member can be mounted as aforesaid by engaging the adhesive layer to the one of the door and the wall and applying sufficient pressure affect adhesive bonding.

38. A door safety device for use in conjunction with a door that is movably mounted to a wall, the wall having a pair of opposing sides and an opening formed therethrough from one of the opposing sides thereof to the other of the opposing sides thereof, the door being movable between an open position wherein the door uncovers the opening to allow the travel of persons therethrough and a closed position wherein the door covers the opening to prevent the travel of persons therethrough, said door safety device comprising:

a molded plastic base member constructed and arranged to be mounted at a desired height on one of the door and the wall, said base member having an engaging member mounting portion;

a molded plastic engaging member having a base member mounting portion, said base member mounting portion being rotatably mounted to said engaging member mounting portion to enable said engaging member to be rotated relative to said base member between an operative position and an inoperative position, said base member mounting portion and said engaging member mounting portion being coupled together in a snap-fit with interengaging surfaces interengaging one another to retain said engaging member on said base member;

said engaging member being constructed and arranged such that, when said base member is mounted as aforesaid and said engaging member is rotated to the operative position thereof, moving the door toward the closed position thereof causes said engaging member to engage the other of the door and the wall so as to prevent the door from moving into the closed position thereof and thereby maintain the door in a partially closed position;

said engaging member being constructed and arranged such that, when said base member is mounted as aforesaid and said engaging member is rotated to the inoperative position thereof, the door can be moved into the closed position thereof without interference from said engaging member.

39. A door safety device according to claim 38, wherein said engaging member and said base member are constructed and arranged such that said engaging member rotates between the inoperative and operative positions thereof in an indexing manner.

40. A door safety device according to claim 39, wherein the engaging member mounting portion of said base member has a resiliently movable tab with projection receiving spaces defined on opposing sides thereof and wherein the base member mounting portion of said engaging member has a projection that is configured to be received within said projection receiving spaces, said projection and said resiliently movable tab being constructed and arranged such that (1) said projection is received within a first of said projection receiving spaces when said engaging member is in the operative position thereof with said tab providing resistance to movement of said projection from said first projection receiving space, thereby releaseably retaining said engaging member in the operative position thereof and (2) said projection is received within a second one of said projection receiving space when said engaging member is in said inoperative position thereof with said tab providing resistance to movement of said projection from said second projection receiving space, thereby releaseably retaining said engaging member in the inoperative position thereof, said projection and said tab being constructed and arranged such that as said engaging member is being rotated between the operative and inoperative positions thereof said projection engages and moves said tab against the resiliency thereof so that said projection can be moved between the first and second projection receiving spaces and said tab thereafter resiliently returns to its initial position to provide resistance to movement of said projection.

41. A door safety device according to claim 40, wherein the engaging member mounting portion of said base member is a generally cylindrical post member and wherein the base member mounting portion of said engaging member has a generally tubular body member, said engaging member being mounted to said base member by placing said body member over said post member such that said engaging member can be rotated between the operative and inoperative positions thereof.

42. A door safety device according to claim 41, wherein said engaging member has a stopping member extending generally radially from said body member, said stopping member being constructed and arranged such that, when said base member is mounted as aforesaid and said engaging member is rotated to the operative position thereof, moving the door toward the closed position thereof causes said stopping member to engage the other of the door and the wall so as to prevent the door from moving into the closed position thereof and thereby maintain the door in the partially closed position.

43. A door safety device according to claim 42, wherein said base member has a plurality of fastener receiving openings configured such that a plurality of fasteners can be inserted there through to mount said base member.

44. A door safety device according to claim 42, wherein said base member has a layer of pressure-sensitive adhesive formed thereon such that said base member can be mounted as aforesaid by engaging the adhesive layer to the one of the door and the wall and applying sufficient pressure affect adhesive bonding.

45. A door safety device according to claim 39, wherein said engaging member is rotatable to a second operative position;

said engaging member being constructed and arranged such that, when said base member is mounted as aforesaid and said engaging member is rotated to the second operative position thereof, moving the door toward the closed position thereof causes said engaging member to engage the other of the door and the portion of the wall so as to prevent the door from moving into the closed position thereof and thereby maintain the door at a second partially closed position, said second partially closed position being closer to the closed position of the door than the aforesaid partially closed position.

46. A door safety device according to claim 45, wherein said base member has a generally cylindrical post member and wherein said engaging member has a generally tubular body member, said engaging member being mounted to said base member by placing said body member over said post member such that said engaging member can be rotated between the operative, second operative, and inoperative positions thereof.

47. A door safety device according to claim 46, wherein said engaging member has first and second stopping members extending radially from said body member and spaced generally axially apart from one another along said body member;

said first stopping member being constructed and arranged such that, when said base member is mounted as aforesaid and said engaging member is rotated to the operative position thereof, moving the door toward the closed position thereof causes said first stopping member to engage the other of the door and the wall so as to prevent the door from moving into the closed position thereof and thereby maintain the door in the aforesaid partially closed position thereof;

said second stopping member being constructed and arranged such that, when said base member is mounted as aforesaid and said engaging member is rotated to the second operative position thereof, moving the door into the closed position thereof causes said second stopping member to engage the other of the door and the wall so as to prevent the door from moving into the closed position thereof and thereby maintain the door in the aforesaid second partially closed position thereof.

48. A door safety device according to claim 47, wherein said base member has a plurality of fastener receiving openings configured such that a plurality of fasteners can be inserted there through to mount said base member.

49. A door safety device according to claim 47, wherein said base member has a layer of pressure-sensitive adhesive formed thereon such that said base member can be mounted as aforesaid by engaging the adhesive layer to the one of the door and the wall and applying sufficient pressure affect adhesive bonding.

* * * * *